US005988286A

United States Patent [19]

Dwiggins

[11] Patent Number: 5,988,286

[45] Date of Patent: Nov. 23, 1999

[54] CABLE ANCHOR ASSEMBLY

[75] Inventor: Jeffrey L. Dwiggins, Windsor, United Kingdom

[73] Assignee: Camco International, Inc., Houston, Tex.

[21] Appl. No.: 08/873,980

[22] Filed: Jun. 12, 1997

[51] Int. Cl.[6] ..... E21B 19/02; E21B 23/04

[52] U.S. Cl. ..... 166/382; 166/212; 166/217; 166/385

[58] Field of Search ..... 166/212, 217, 166/382, 242.2, 385

[56] References Cited

U.S. PATENT DOCUMENTS

| | | | |
|---|---|---|---|
| H1232 | 9/1993 | Disiena | 166/385 |
| 3,087,552 | 4/1963 | Graham | 166/212 |
| 3,835,929 | 9/1974 | Suman, Jr. . | |
| 4,336,415 | 6/1982 | Walling . | |
| 4,346,256 | 8/1982 | Hubbard et al. . | |
| 4,428,422 | 1/1984 | Laurent | 166/212 |
| 4,681,169 | 7/1987 | Brookbank, III . | |
| 4,830,113 | 5/1989 | Geyer . | |
| 5,145,007 | 9/1992 | Dinkins . | |
| 5,146,982 | 9/1992 | Dinkins . | |
| 5,180,014 | 1/1993 | Cox . | |
| 5,191,173 | 3/1993 | Sizer et al. . | |
| 5,193,614 | 3/1993 | Cox . | |
| 5,269,377 | 12/1993 | Martin . | |
| 5,435,351 | 7/1995 | Head . | |
| 5,769,163 | 6/1998 | Meynier | 166/206 |

*Primary Examiner*—Hoang C. Dang
*Attorney, Agent, or Firm*—Fletcher, Yoder & Van Someren

[57] ABSTRACT

A cable anchor for preventing longitudinal movement of a cable within a conduit to transfer the weight of the cable to the conduit, comprises a housing connectable to the cable. An arm member is connected to the housing and is movable from a retracted position to an extended position in gripping contact with an interior surface of the conduit to thereby transfer the weight of the cable to the conduit. A piston and cylinder assembly, operable from fluid pressure within the conduit, is connected to the housing and in operable contact with the arm member to extend the arm member.

20 Claims, 2 Drawing Sheets

CABLE ANCHOR ASSEMBLY

BACKGROUND OF THE INVENTION

1. Field of the Invention

The present invention relates to devices used to restrain the movement of a cable that is disposed within a conduit and, more particularly, to cable anchor devices used within coiled tubing to suspend an electric submergible pumping system within a wellbore.

2. Description of Related Art

To reduce the size of equipment and the associated costs needed to deploy and recover an electric submergible pumping system ("ESP"), ESP's can be suspended from coiled tubing, rather than conventional jointed tubing. This method takes advantage of the relatively low cost and ease of transportation of the units used to install and remove coiled tubing. A typical arrangement for suspending an ESP on coiled tubing is disclosed in U.S. Pat. Nos. 3,835,929; 4,830,113; and 5,180,014.

The cable that is used to connect the ESP to a surface power source does not have sufficient internal strength to support its own weight over about 60 to 200 feet. Therefore, the cable is clamped, banded or strapped to the jointed tubing or the coiled tubing at intervals of about every 50 to 150 feet, as disclosed in U.S. Pat. No. 4,681,169. Alternatively, the cable can be encased within the coiled tubing, as disclosed in U.S. Pat. Nos. 4,336,415; 4,346,256; 5,145,007; 5,146,982; and 5,191,173.

When the cable is encased within the coiled tubing, standoff devices can be used to centralize the cable within the coiled tubing to permit fluid production through the coiled tubing. These standoff devices also support the cable, in place of the external clamps or straps, by preventing longitudinal movement of the cable with respect to the coiled tubing and thereby transfer the weight of the cable to the coiled tubing. These standoff devices are usually referred to as cable anchors, and are disclosed in U.S. Pat. Nos. 5,193,614; 5,269,377; and 5,435,351.

Common problems associated with the prior cable anchors are that such cable anchors are either (i) relatively mechanically complex, and require injection of a solvent to release the anchors, or (ii) require a time consuming and uncontrollable chemical interaction to cause elastomeric materials to swell. There is a need for a simple mechanical cable anchor assembly that is quickly and predictably operable by fluid pressure, and is not dependent upon the uncertain nature of chemical interactions and solvents.

SUMMARY OF THE INVENTION

The present invention has been contemplated to overcome the foregoing deficiencies and meet the above described needs. Specifically, the present invention is a relatively simple mechanical cable anchor assembly for preventing longitudinal movement of a cable within a conduit. The cable anchor assembly transfers the weight of the cable to the conduit in place of prior external clamps or bands. The cable anchor comprises a one or two piece housing connectable about the cable, with an arm member movable from a retracted position to an extended position in gripping contact with an interior surface of the conduit. A piston and cylinder assembly, connected to the housing, is operable by an increase in fluid pressure within the conduit to cause the piston to move within the cylinder and thereby move the arm member to its extended position, without the need for chemical reactions to cause swelling or solvents.

DETAILED DESCRIPTION OF THE PREFERRED EMBODIMENTS

As described briefly above, the present invention is a cable anchor assembly and its method of use for preventing longitudinal movement of a cable within a conduit, and to transfer the weight of the cable to the conduit. The cable anchor comprises a housing connectable to the cable, with one or more arm members movable from a retracted position to an extended position in gripping contact with an interior surface of the conduit. A piston and cylinder assembly, operable from fluid pressure within the conduit, is connected to the housing and is in operable contact with the arm member to extend the arm member.

For the purposes of the present discussion it will be assumed that the cable anchor assembly of the present invention is used within coiled tubing; however, it should be understood that the cable anchor assembly of the present invention can be used with any type of conduit, such as jointed tubing and the like. Further, for the purposes of the present discussion it will be assumed that the cable anchor assembly of the present invention is used with power cable connected to an ESP; however, it should be understood that the cable anchor assembly of the present invention can be used with any type of conduit, cable, wire or rope, such as fiber optics, hydraulic control lines, and the like, as well as for providing communications to and from or conveying and retrieving equipment, such as logging tools, drilling tools, wireline tools, steam generators and the like, within a wellbore.

Figure 1:
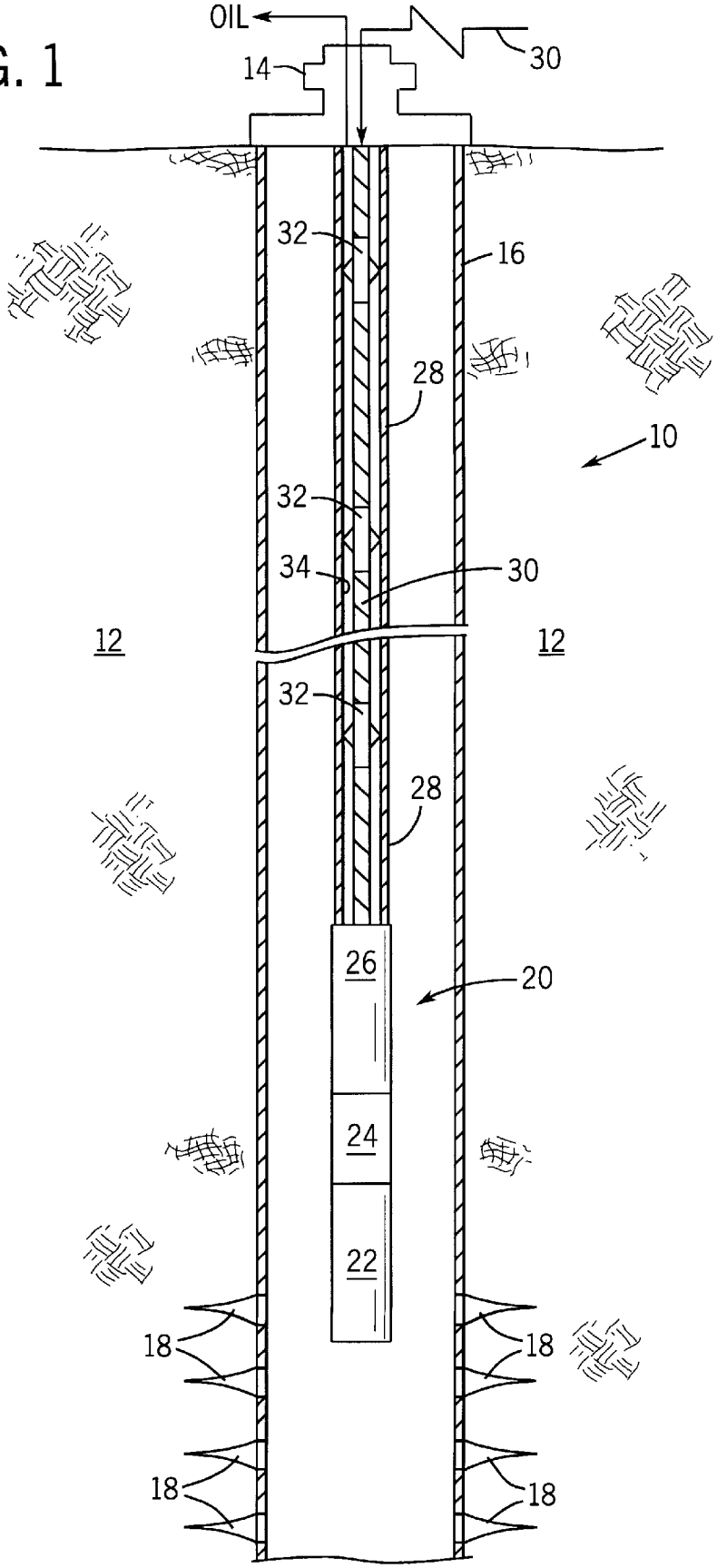
FIG. 1 is a partial cross section of a subterranean wellbore with an ESP suspended on coiled tubing therein, and with a plurality of cable anchor assemblies of the present invention clamped about a power cable disposed within the coiled tubing.

To better understand the present invention, reference will be made to the accompanying drawings. FIG. 1 shows a wellbore 10, used for recovering fluids such as water and/or hydrocarbons, that penetrates one or more subterranean earthen formations 12. The wellbore 10 includes a wellhead 14 removably connected to an upper portion of a production tubing and/or casing string 16, as is well known to those skilled in the art. If the casing string 16 extends across a fluid producing subterranean formation 12, then the casing string 16 can include at least one opening or perforations 18 for permitting fluids to enter the interior thereof. An electric submergible pumping system ("ESP") 20 is shown suspended within the casing string 16, and generally includes an electric motor 22, an oil-filled motor protector 24, and a pump 26. The ESP 20 is shown in FIG. 1 in a conventional arrangement with the motor 22 lower within the wellbore 10 than the pump 26; however, it should be understood that the present invention can be used when the ESP 20 is deployed in an "up-side down" configuration, commonly known as a "bottom intake system", with the motor 22 above the pump 26.

The ESP 20 is operatively connected to a lower end of a length of coiled tubing 28 that has been spooled into the casing 16, as is well known to those skilled in the art. The coiled tubing 28 can be of any commercially available size (ie. outside/inside diameter) and formed from any material suitable to the wellbore conditions, as all is well known in the art. For examples, typical sizes of coiled tubing are from 0.75" OD to 3.5" OD, and are made from aluminum, steel and titanium.

An electrical cable 30 is operatively connected to the ESP 20 to provide electrical power to the motor 22, and is operatively connected at the surface to surface electrical control equipment and a source of electrical power (both not shown), as are both well known in the art. Commercially available electrical cable 30 typically used with ESP's 20 does not have sufficient internal strength to support its own freely suspended weight; therefore, a plurality of cable anchor assemblies 32, of the present invention, are shown inserted within the coiled tubing 28. The cable anchor assemblies 32 are used to support the weight of the cable 30, and provide as open of an annulus 34 as possible between the cable 30 and the interior surface of the coiled tubing 28. The cable anchor assemblies 32 can centralize the cable 30 within the coiled tubing 28, or displace the cable to one side, as is desired. Again, depending upon the type and diameter of the cable 30, the cable anchor assemblies 32 are spaced about every 50–200 feet.

Figure 2:
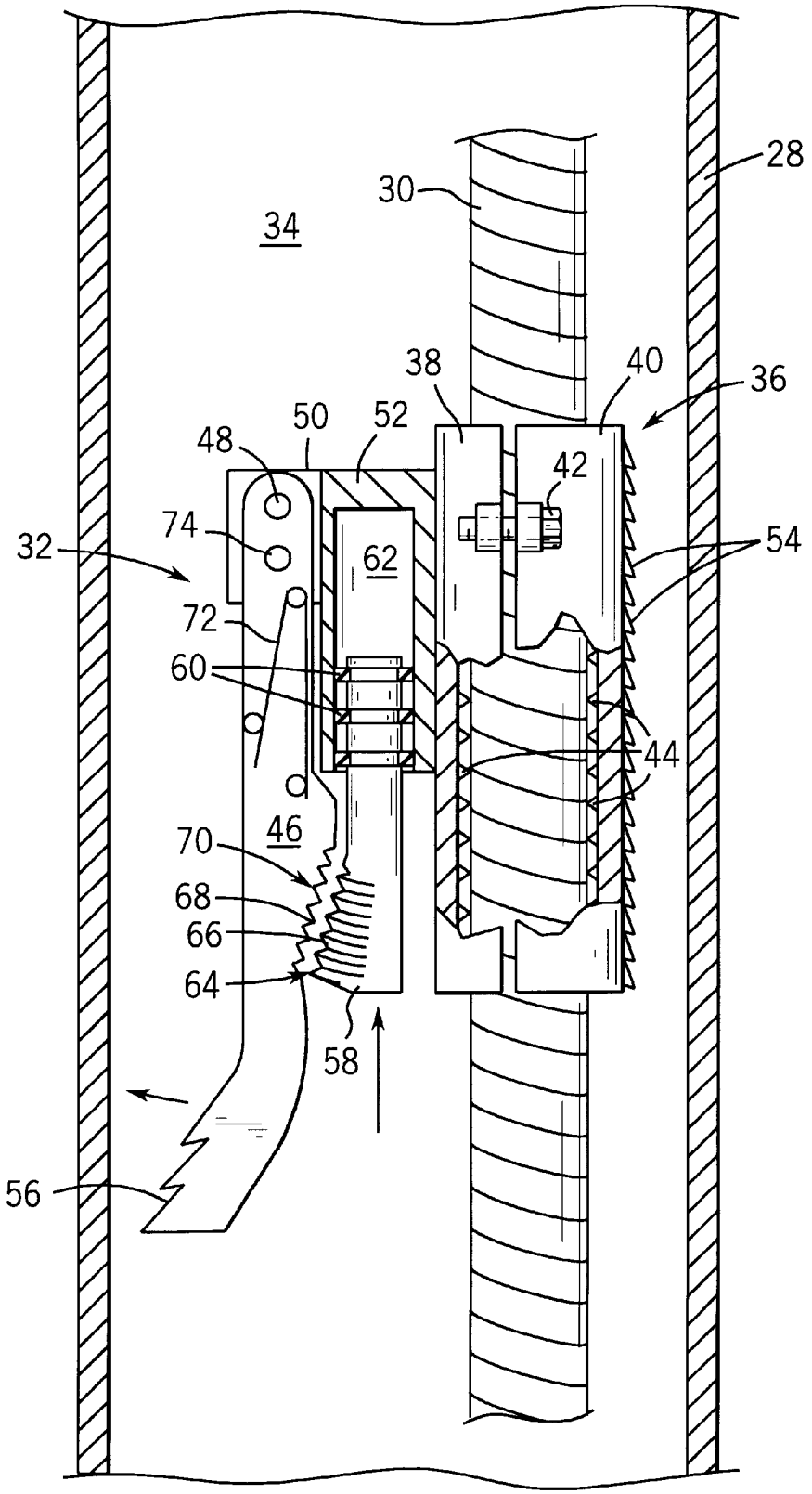
FIG. 2 is a partial cross-section of one preferred embodiment of a cable anchor assembly of the present invention.

FIG. 2 shows one preferred embodiment of a cable anchor assembly 32 of the present invention with a housing 36 shown connected about the cable 30. The housing 36 can be a single curved member with means to connect same to the cable 30, such as by bolts, bands or straps. The housing 36 can also, preferably, comprise a first body 38 and a second body 40 that are connected about the cable 30, by means of straps, bands, or bolts 42. Also, on lateral edge of each of the bodies 38 and 40 can include a hinge (not shown), so that the bodies 38 and 40 can form an assembly that is easily opened, placed about the cable 30, and then closed and secured. An interior surface of each of the bodies 38 and 40 are curved to accept the cable 30 therebetween, with the diameter of the curvature chosen so that once the cable anchor assembly 32 is closed, the cable 30 is secured thereto and is prevented from longitudinal movement. In addition, an interior surface of one or both of the bodies 38 and 40 includes annular grooves, serrations or teeth 44 to grip the cable 30 and thereby aid in preventing longitudinal movement of the cable 30 with respect to the housing 36.

An arm member 46 extends from the housing 36, and is pivoted about a pin 48 that extends through an outer flange 50. The flange 50 is connected to or is formed as part of the body 38 or is connected to or is formed as part of a cylinder 52 (as shown in FIG. 2), that is connected to or is formed as part of the body 38. Two or more arm members 46 can be pivotally connected to the housing 36, at equal spacing or unequal spacing as desired, with two or three arm members 46 being preferable. If one arm member 46 is used or if unequal spacing of two or more arm members 46 is used, then the cable 30 and the housing 36 are pressed against one side of an interior surface of the coiled tubing 28. To aid in preventing longitudinal movement of the housing 36 and the cable 30 with respect to the coiled tubing 28, an exterior surface of the first body 38 and/or the second body 40 includes ridges or teeth 54 that are pressed into and grip the coiled tubing 28.

The primary means for preventing longitudinal movement of the housing 36 and the cable 30 with respect to the coiled tubing 28 are the arm members 46, and more specifically, an outer end of each of the arm members 46 includes ridges or teeth 56 on an exterior surface thereof that are pressed into and grip the coiled tubing 28 when the arm member(s) 46 are extended.

In FIG. 2, the arm member 46 is shown in a retracted position that permits the cable anchor assembly 32 to be moved within the coiled tubing 28 in either longitudinal direction. In order to move the arm member 46 to an extended position, that is in gripping contact with the interior surface of the coiled tubing 28, each housing 36 includes a piston and cylinder assembly formed from the cylinder 52 and a piston 58. The piston 58 includes one or more sealing rings 60 adjacent one end thereof, and such end is inserted into a bore 62 formed in the cylinder 52. As shown in FIG. 2, an outer end 64 of the piston 58 is conical in shape or is inclined, and includes a plurality of ratchet grooves or teeth 66 that cooperate with ratchet grooves or teeth 68 in an inclined underside 70 of the arm member 46.

The piston 58 is forced into the cylinder bore 62 by an increase in the fluid pressure within the coiled tubing 28, such as by the introduction thereinto of compressed gas, such as air or nitrogen, and/or by the introduction thereinto of liquids pumped from the earth's surface or from the natural reservoir pressure of the subterranean fluids. This method of operation will be described in more detail below. As the piston 58 moves inwardly, the outer end of the piston 64 rides along and pushes outwardly the underside 70 of the arm member 46 to extend same into gripping contact with the coiled tubing 28. To aid in moving the arm member, a spring 72 is mounted to the housing 36 and forces outwardly the arm member 46. The ratchet teeth 66 and 68 cooperate to prevent the arm member 46 from retracting once it is extended. In this manner, the weight of the cable 30 is transferred through the housing 36 and the arm member 46 to the interior surface of the coiled tubing 28, and the cable 30 is prevented from moving longitudinally with respect to coiled tubing 28.

The preferred embodiments of the cable anchor assemblies 32 of present invention are adapted to have gripping means 54 and/or 56 that operate to prevent longitudinal movement of the cable 30 with respect to the coiled tubing 28 in either direction. However, the gripping means can be configured by the shape of the teeth 54 and/or 56 to operate only in one longitudinal direction so that even after the arm members 46 have been extended, the cable 30 can be pulled out from the coiled tubing 28 in an opposite longitudinal direction.

In one preferred method of the present invention, the cable anchor assemblies 32 are used as follows. The cable anchor assemblies 32 are opened and then closed about the cable 30, and then are bolted or clamped shut to be secured to the cable 30 at intervals of about every 50 to 200 feet, depending upon the type and diameter of the cable 30. The cable 30 is slid into the coiled tubing 38 during the manufacturing process of the coiled tubing, i.e. the cable 30 and anchor assemblies 32 are laid onto a flat ribbon of tubing material that is then rolled into a tube and the resulting seam is welded to form coiled tubing. Alternatively, the cable 30 with the anchor assemblies 32 is run into the coiled tubing 28 by pulling of a guide wire attached to one end thereof and extending through the coiled tubing or by forcing the cable 30 thereinto by pressurized fluids, as is known to those skilled in the art. To ensure that the arm members 46 stay retracted during the installation process, a band (not shown) is extended across the housing 36 and the arm member 46, or a shear pin 74 can extend through the arm member 46 and into the flange 50.

The cable anchor assemblies 32 can be activated, i.e. have the arm members 46 extended to prevent longitudinal movement of the cable 30 within the coiled tubing 28, during the manufacturing process or at the well site, as will be described below. Alternatively, the cable anchor assemblies 32 can be activated once the ESP 20 has been connected thereto and lowered into the casing 16. The ESP 20 is lowered to the desired depth in the wellbore 14 by unreeling the coiled tubing 28 from its transport reel, as is known to those skilled in the art. Regardless of when the anchor assemblies 32 are activated, they are activated in the following manner. A source of fluid pressure is placed in communication with the interior of the coiled tubing 28, and fluid pressure is increased until a predetermined pressure exists that causes the piston 58 to be forced into the bore 62. The surface area of the piston 58 determines the amount of force generated, and it must be more than the shear strength of the bands or shear pins 74. The spring 72 aids in trying to move the arm member 46 outwardly as the increase in fluid pressure drives the piston 58 into the cylinder 52.

As the piston 58 moves inwardly, the inclined outer end 64 thereof acts upon the inclined underside 70 of the arm member 46 to cause the arm member 46 to move outwardly. As the arm member 46 is extended, the teeth 56 and/or 54 come into gripping contact with the interior surface of the coiled tubing 28. Further movement of the piston 58 causes the arm member 46 to anchor the housing 36 and the cable 30 to the coiled tubing 28, and thereby prevent longitudinal movement of the cable 30 with respect to the coiled tubing 28 in at least one longitudinal direction. The teeth or grooves 66 and 68 act as a ratchet mechanism to prevent the arm member 46 from retracting and thereby secure the cable 30. Fluid pressure can then be released from inside of the coiled tubing 28. Once the ESP 20 is connected to the cable 30 and the coiled tubing 28, and suspended within the wellbore 10, the anchor assemblies 32 transfer the weight of the cable 30 to the coiled tubing 28.

As can be understood from the above discussion, the cable anchors of the present invention are relatively simple, as compared to previous mechanical cable anchors, and do not require the injection of a solvent to release the anchors or require a time consuming and uncontrollable chemical interaction to cause elastomeric materials to swell.

Wherein the present invention has been described in particular relation to the drawings attached hereto, it should be understood that other and further modifications, apart from those from those shown or suggested herein, may be made within the scope and spirit of the present invention.

What is claimed:

1. A cable anchor comprising:

a housing connectable to a cable disposed within a conduit, the housing including a first body and a second body connectable about the cable;

an arm member connected to the housing and movable from a retracted position to an extended position in gripping contact with an interior surface of the conduit; and, a fluid actuating assembly on the housing and in operable contact with the arm, and moveable from a first position when the arm member is in the retracted position to a second position to move the arm member to the extended position.

2. A cable anchor of claim 1 wherein the first body is hingedly connected to the second body.

3. A cable anchor of claim 1 wherein the first body is bolted to the second body.

4. A cable anchor of claim 1 wherein the housing includes gripping means on an interior surface thereof for preventing movement of the housing in a first longitudinal direction with respect to the cable.

5. A cable anchor of claim 1 wherein the arm member is pivotally connected to the housing.

6. A cable anchor of claim 1 wherein the arm member includes gripping means on an exterior surface thereof for preventing movement of the housing in a first longitudinal direction with respect to the conduit, and thereby transfer the weight of the cable to the conduit.

7. A cable anchor of claim 1 and further comprising spring means for biasing the arm member to the extended position.

8. A cable anchor of claim 1 and further comprising a plurality of arm members connected to the housing.

9. A cable anchor of claim 1 wherein the fluid actuating assembly comprises a cylinder housing connected to the housing, and having a bore extending thereinto; a piston moveable within the cylinder bore; and an external end of the piston in operative contact with the arm member.

10. A cable anchor of claim 9 wherein the external end of the piston is inclined to assist in extending the arm member.

11. A cable anchor of claim 9 wherein the piston and the arm member include cooperable ratchet means to prevent the arm member from retracting once extended.

12. A cable anchor comprising:

a housing connectable to a cable disposed within a conduit;

gripping means on an interior surface of the housing for preventing movement of the housing in a first longitudinal direction with respect to the cable;

an arm member pivotally connected to the housing and movable from a retracted position to an extended position in contact with an interior surface of the conduit;

gripping means on an exterior surface of the arm member for preventing movement of the housing in a first longitudinal direction with respect to the conduit; and piston and cylinder assembly on the housing and in operable contact with the arm, and moveable from a first position when the arm member is in the retracted position to a second position to move the arm member to the extended position.

13. A cable anchor comprising:

a housing connectable to a cable disposed within a conduit;

an arm member pivotally connected to the housing and movable from a retracted position to an extended position in contact with an interior surface of the conduit;

gripping means on an exterior surface of the arm member for preventing movement of the housing in a first longitudinal direction with respect to the conduit; and a piston and cylinder assembly comprising a cylinder housing connected to the housing, and having a bore extending thereinto generally parallel to the cable, a piston moveable within the cylinder bore with an external end of the piston in operative contact with the arm member, and the piston moveable in a direction generally parallel to the cable from a first position when the arm member is in the retracted position to a second position to move the arm member to the extended position.

14. A cable anchor of claim 13 and further comprising a plurality of arm members connected to the housing.

15. A method of securing a cable within a conduit, comprising:

(a) affixing a plurality of cable anchors about a cable;

(b) inserting the cable and the cable anchors into a conduit in a first longitudinal direction; and (c) increasing fluid pressure within the conduit to cause a piston and cylinder assembly to move an arm member from a retracted position to an extended position in contact with an interior surface of the conduit and thereby prevent movement of the cable with respect to the conduit in a second longitudinal direction.

16. The method of claim 15 wherein when the arm member is extended the weight of the cable is transferred to the conduit.

17. The method of claim 15 wherein the cable anchors are affixed to the cable by bolts.

18. The method of claim 15 wherein the cable anchors are clamped about the cable.

19. The method of claim 15 wherein once the arm member is extended, ratchet means are activated to prevent the retraction of the arm member.

20. A cable anchor comprising:

an anchor housing connectable to an exterior surface of a cable disposed within a conduit, the housing including means on an interior surface thereof for preventing movement of the housing in a first longitudinal direction with respect to the cable;

an arm member connected to the housing and movable from a retracted position to an extended position in gripping contact with an interior surface of the conduit; and a fluid actuating assembly on the housing and in operable contact with the arm, and moveable from a first position when the arm member is in the retracted position to a second position to move the arm member to the extended position.

* * * * *